US007249635B2

(12) United States Patent
Dennistoun et al.

(10) Patent No.: US 7,249,635 B2
(45) Date of Patent: Jul. 31, 2007

(54) COMMUNICATION TOOL FOR ACCESSING A NON ANNULAR HYDRAULIC CHAMBER OF A SUBSURFACE SAFETY VALVE

(75) Inventors: Stuart M. Dennistoun, Carrollton, TX (US); Roddie Robert Smith, Cypress, TX (US); Imre I. Gazda, Forth Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/324,942

(22) Filed: Jan. 4, 2006

(65) Prior Publication Data

US 2006/0113081 A1 Jun. 1, 2006

Related U.S. Application Data

(60) Continuation of application No. 10/973,147, filed on Oct. 26, 2004, now Pat. No. 7,032,672, which is a continuation of application No. 10/635,076, filed on Aug. 6, 2003, now Pat. No. 6,880,641, which is a continuation of application No. 10/292,160, filed on Nov. 12, 2002, now Pat. No. 6,659,185, which is a division of application No. 09/838,604, filed on Apr. 19, 2001, now Pat. No. 6,523,614.

(51) Int. Cl.
*E21B 34/06* (2006.01)

(52) U.S. Cl. ..... 166/373; 166/322; 166/277

(58) Field of Classification Search ..... 166/373, 166/374, 375, 244.1, 316, 319, 321, 322, 166/72, 192, 277
See application file for complete search history.

(56) References Cited

U.S. PATENT DOCUMENTS

| | | | | |
|---|---|---|---|---|
| 3,111,989 | A | 11/1963 | Tamplen | |
| 3,301,337 | A * | 1/1967 | Vaughn et al. | 175/22 |
| 3,696,868 | A | 10/1972 | Taylor, Jr. | |
| 3,763,932 | A | 10/1973 | Dinning | |
| 3,786,865 | A | 1/1974 | Tausch et al. | |
| 3,786,866 | A | 1/1974 | Tausch et al. | |
| 3,799,258 | A | 3/1974 | Tausch | |
| 3,981,358 | A | 9/1976 | Watkins et al. | |

(Continued)

OTHER PUBLICATIONS

European Search Report; European Patent Office; Feb. 7, 2006; 5 pages.

(Continued)

*Primary Examiner*—David Bagnell
*Assistant Examiner*—Daniel P Stephenson
(74) *Attorney, Agent, or Firm*—Lawrence R. Youst

(57) ABSTRACT

A communication tool (100) includes a housing (102) having recesses (110) and a set of axial locating elements (112) radially extendable through the recesses (110) and engagably positionable within a profile of a tubing retrievable safety valve (50). An anti rotation device (140) is radially outwardly extendable relative to the housing (112). The anti rotation device (140) operably engages the tubing retrievable safety valve (50) to substantially prevent relative rotation between at least a portion of the communication tool (100) and the tubing retrievable safety valve (50). A cutting tool (148) is radially outwardly extendable relative to the housing (102). The cutting tool (148) is operable to create a fluid passageway (150) between a non annular hydraulic chamber (60) and an interior the tubing retrievable safety valve (50).

58 Claims, 10 Drawing Sheets

U.S. PATENT DOCUMENTS

| | | | |
|---|---|---|---|
| 4,077,473 | A | 3/1978 | Watkins |
| 4,161,960 | A | 7/1979 | Watkins |
| 4,201,363 | A | 5/1980 | Arendt et al. |
| 4,215,748 | A | 8/1980 | Pace et al. |
| 4,273,194 | A | 6/1981 | Pringle et al. |
| 4,310,048 | A | 1/1982 | Mott |
| 4,319,639 | A | 3/1982 | Mott |
| 4,344,602 | A | 8/1982 | Arendt |
| 4,356,867 | A | 11/1982 | Carmody |
| 4,411,316 | A | 10/1983 | Carmody |
| 4,449,587 | A | 5/1984 | Rodenberger et al. |
| 4,475,599 | A | 10/1984 | Akkerman |
| 4,542,792 | A | 9/1985 | Akkerman |
| 4,574,889 | A | 3/1986 | Pringle |
| 4,577,694 | A | 3/1986 | Brakhage, Jr. |
| 4,603,740 | A | 8/1986 | Edwards et al. |
| 4,605,070 | A | 8/1986 | Morris |
| 4,606,410 | A | 8/1986 | Becker et al. |
| 4,624,315 | A | 11/1986 | Dickson et al. |
| 4,723,606 | A | 2/1988 | Vinzant et al. |
| 4,796,705 | A | 1/1989 | Carmody et al. |
| 4,944,351 | A | 7/1990 | Eriksen et al. |
| 4,951,753 | A | 8/1990 | Eriksen |
| 4,967,845 | A | 11/1990 | Shirk |
| 4,981,177 | A | 1/1991 | Carmody et al. |
| 5,127,476 | A | 7/1992 | Dickson et al. |
| 5,165,480 | A | 11/1992 | Wagoner et al. |
| 5,167,284 | A | 12/1992 | Leismer |
| 5,226,483 | A | 7/1993 | Williamson, Jr. |
| 5,249,630 | A | 10/1993 | Meaders et al. |
| 5,263,847 | A | 11/1993 | Akkerman et al. |
| 5,293,943 | A | 3/1994 | Williamson, Jr. |
| 5,314,026 | A | 5/1994 | Williamson, Jr. |
| 5,343,955 | A | 9/1994 | Williams |
| 5,496,044 | A | 3/1996 | Beall et al. |
| 5,564,675 | A | 10/1996 | Hill, Jr. et al. |
| 5,575,331 | A | 11/1996 | Terrell |
| 5,598,864 | A | 2/1997 | Johnston et al. |
| 5,799,949 | A | 9/1998 | Beall et al. |
| 6,059,041 | A | 5/2000 | Scott |
| 6,173,785 | B1 | 1/2001 | Adams et al. |
| 6,260,850 | B1 | 7/2001 | Beall et al. |
| 6,273,187 | B1 | 8/2001 | Voisin, Jr. et al. |
| 6,283,477 | B1 | 9/2001 | Beall et al. |
| 6,352,118 | B1 | 3/2002 | Dickson et al. |
| 6,523,614 | B2 | 2/2003 | Dennistoun et al. |
| 6,659,185 | B2 | 12/2003 | Dennistoun et al. |
| 6,742,595 | B2 | 6/2004 | Dennistoun et al. |
| 6,880,641 | B2 | 4/2005 | Dennistoun et al. |
| 6,953,093 | B2 | 10/2005 | Dennistoun et al. |
| 2003/0173089 | A1 | 9/2003 | Westgaud et al. |
| 2004/0026087 | A1 | 2/2004 | Dennistoun et al. |

OTHER PUBLICATIONS

European Search Report; European Patent Office; Feb. 13, 2006; 5 pages.

* cited by examiner 10
18
40
46
20
12
24
22
42
48
26
16
30
44
28
38
32
36
14
34

COMMUNICATION TOOL FOR ACCESSING A NON ANNULAR HYDRAULIC CHAMBER OF A SUBSURFACE SAFETY VALVE

CROSS-REFERENCE TO RELATED PATENT APPLICATIONS

This is a continuation application of application Ser. No. 10/973,147, filed on Oct. 26, 2004 now U.S. Pat. No. 7,032,672, which is continuation application of application Ser. No. 10/635,076, filed on Aug. 6, 2003, now U.S. Pat. No. 6,880,641 which is a continuation application of application Ser. No. 10/292,160, filed on Nov. 12, 2002, now U.S. Pat. No. 6,659,185 which is a divisional application of application Ser. No. 09/838,604, filed on Apr. 19, 2001, now U.S. Pat. No. 6,523,614.

TECHNICAL FIELD OF THE INVENTION

This invention relates in general, to the operation of a subsurface safety valve installed in the tubing of a subterranean wellbore and, in particular, to an apparatus and method for communicating hydraulic fluid through the subsurface safety valve.

BACKGROUND OF THE INVENTION

One or more subsurface safety valves are commonly installed as part of the tubing string within oil and gas wells to protect against unwanted communication of high pressure and high temperature formation fluids to the surface. These subsurface safety valves are designed to shut in production from the formation in response to a variety of abnormal and potentially dangerous conditions.

As these subsurface safety valves are built into the tubing string, these valves are typically referred to as tubing retrievable safety valves ("TRSV"). TRSVs are normally operated by hydraulic fluid pressure which is typically controlled at the surface and transmitted to the TRSV via a hydraulic fluid line. Hydraulic fluid pressure must be applied to the TRSV to place the TRSV in the open position. When hydraulic fluid pressure is lost, the TRSV will operate to the closed position to prevent formation fluids from traveling therethrough. As such, TRSVs are fail safe valves.

As TRSVs are often subjected to years of service in severe operating conditions, failure of TRSVs may occur. For example, a TRSV in the closed position may leak. Alternatively, a TRSV in the closed position may not properly open. Because of the potential for disaster in the absence of a properly functioning TRSV, it is vital that the malfunctioning TRSV be promptly replaced or repaired.

As TRSVs are typically incorporated into the tubing string, removal of the tubing string to replace or repair the malfunctioning TRSV is required. As such, the costs associated with replacing or repairing the malfunctioning TRSV is quite high. It has been found, however, that a wireline retrievable safety valve ("WRSV") may be inserted inside the original TRSV and operated to provide the same safety function as the original TRSV. These insert valves are designed to be lowered into place from the surface via wireline and locked inside the original TRSV. This approach can be a much more efficient and cost-effective alternative to pulling the tubing string to replace or repair the malfunctioning TRSV.

One type of WRSV that can take over the full functionality of the original TRSV requires that the hydraulic fluid from the control system be communicated through the original TRSV to the inserted WRSV. In traditional TRSVs, this communication path for the hydraulic fluid is established through a pre-machined radial bore extending from the hydraulic chamber to the interior of the TRSV. Once a failure in the TRSV has been detected, this communication path is established by first shifting a built-in lock out sleeve within the TRSV to its locked out position and shearing a shear plug that is installed within the radial bore.

It has been found, however, that operating conventional TRSVs to the locked out position and establishing this communication path has several inherent drawbacks. To begin with, the inclusion of such built-in lock out sleeves in each TRSV increases the cost of the TRSV, particularly in light of the fact that the built-in lock out sleeves are not used in the vast majority of installations. In addition, since these built-in lock out sleeves are not operated for extended periods of time, in most cases years, they may become inoperable before their use is required. Also, it has been found, that the communication path of the pre-machined radial bore creates a potential leak path for formation fluids up through the hydraulic control system. As noted above, TRSVs are intended to operate under abnormal well conditions and serve a vital and potentially lifesaving function. Hence, if such an abnormal condition occurred when one TRSV has been locked out, even if other safety valves have closed the tubing string, high pressure formation fluids may travel to the surface through the hydraulic line.

In addition, manufacturing a TRSV with this radial bore requires several high-precision drilling and thread tapping operations in a difficult-to-machine material. Any mistake in the cutting of these features necessitates that the entire upper subassembly of the TRSV be scrapped. The manufacturing of the radial bore also adds considerable expense to the TRSV, while at the same time reducing the overall reliability of the finished product. Additionally, these added expenses add complexity that must be built into every installed TRSV, while it will only be put to use in some small fraction thereof.

Attempts have been made to overcome these problems. For example, attempts have been made to communicate hydraulic control to a WRSV through a TRSV using a radial cutting tool to create a fluid passageway from an annular hydraulic chamber in the TRSV to the interior of the TRSV such that hydraulic control may be communicated to the insert WRSV. It has been found, however, that such radial cutting tools are not suitable for creating a fluid passageway from the non annular hydraulic chamber of a rod piston operated TRSVs.

Therefore, a need has arisen for an apparatus and method for establishing a communication path for hydraulic fluid to a WRSV from a failed rod piston operated TRSV. A need has also arisen for such an apparatus and method that do not require a built-in lock out sleeve in the rod piston operated TRSV. Further, a need has arisen for such an apparatus and method that do not require the rod piston operated TRSV to have a pre-machined radial bore that creates the potential for formation fluids to travel up through the hydraulic control line.

SUMMARY OF THE INVENTION

The present invention disclosed herein comprises an apparatus and method for establishing a communication path for hydraulic fluid to a wireline retrievable safety valve from a rod piston operated tubing retrievable safety valve. The apparatus and method of the present invention do not require a built-in lock out sleeve in the rod piston operated tubing retrievable safety valve. Likewise, the apparatus and method of the present invention avoid the potential for formation fluids to travel up through the hydraulic control line associated with a pre-drilled radial bore in the tubing retrievable safety valve.

In broad terms, the apparatus of the present invention allows hydraulic control to be communicated from a non annular hydraulic chamber of a rod piston operated tubing retrievable safety valve to the interior thereof so that the hydraulic fluid may, for example, be used to operate a wireline retrievable safety valve. This may become necessary when a malfunction of the rod piston operated tubing retrievable safety valve is detected and a need exists to otherwise achieve the functionality of the rod piston operated tubing retrievable safety valve.

The rod piston operated tubing retrievable safety valve of the present invention has a housing having a longitudinal bore extending therethrough. The safety valve also has a non annular hydraulic chamber in a sidewall portion thereof. A valve closure member is mounted in the housing to control fluid flow through the longitudinal bore by operating between closed and opened positions. A flow tube is disposed within the housing and is used to shift the valve closure member between the closed and opened positions. A rod piston, which is slidably disposed in the non annular hydraulic chamber of the housing, is operably coupled to the flow tube. The safety valve of the present invention also has a pocket in the longitudinal bore.

In one aspect, the present invention is directed to a communication tool that is used to establish a communication path between the non annular hydraulic chamber in a sidewall portion of the safety valve and the interior of the safety valve. The communication tool comprises a housing having recesses, a mandrel slidably disposed within the housing and a set of axial locating elements that is radially extendable through the recesses and engagably positionable within the profile when the mandrel is axially moved relative to the housing behind the axial locating elements. The communication tool also includes an anti rotation device that is radially outwardly extendable relative to the housing. The anti rotation device is operably engageable with the tubing retrievable safety valve to substantially prevent relative rotation between at least a portion of the communication tool and the tubing retrievable safety valve. In addition, the communication tool includes a cutting tool that is radially outwardly extendable relative to the housing. The cutting tool is operable to create a fluid passageway between the non annular hydraulic chamber and the interior of the tubing retrievable safety valve. The cutting tool is axially and circumferentially alignable with the non annular hydraulic chamber when the axial locating elements are engagably positioned within the profile and the anti rotation device is operably engaged with the tubing retrievable safety valve.

In one embodiment, the housing of the communication tool has a first section and a second section that are initially coupled together by a shear pin. In this embodiment, a torsional biasing device is coupled between the first section and the second section which places a torsional load between the first and second sections when the first and second sections are coupled together and rotates the second section relative to the first section when the first and section sections are decoupled.

In one embodiment, the cutting tool may be a radial or mechanical cutting tool such as a punch or an insert having a fluid passageway extending therethough. In this embodiment, a punch rod may be slidably operable relative to the housing to radially outwardly extend the punch through a sidewall portion of the tubing retrievable safety valve and into the non annular hydraulic chamber.

In one embodiment, the anti rotation device may be positioned circumferentially opposite of the cutting tool. In another embodiment, the anti rotation device may include a collet spring and a circumferential locating key that is engageable with the pocket of the safety valve.

BRIEF DESCRIPTION OF THE DRAWINGS

For a more complete understanding of the present invention, including its features and advantages, reference is now made to the detailed description of the invention, taken in conjunction with the accompanying drawings in which like numerals identify like parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
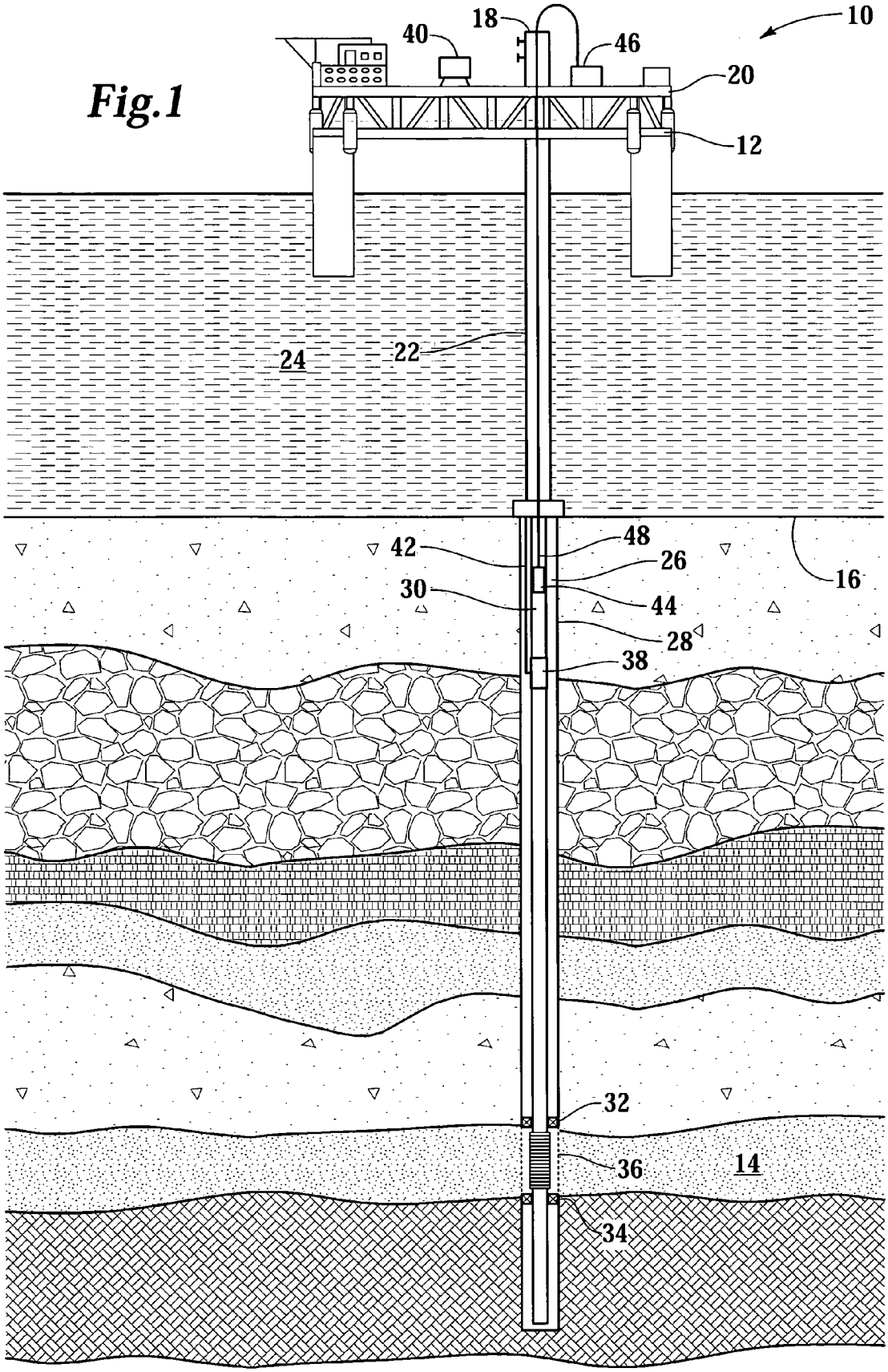
FIG. 1 is a schematic illustration of an offshore production platform wherein a wireline retrievable safety valve is being lowered into a tubing retrievable safety valve to take over the functionality thereof.

Referring to FIG. 1, an offshore oil and gas production platform having a wireline retrievable safety valve lowered into a tubing retrievable safety valve is schematically illustrated and generally designated 10. A semi-submersible platform 12 is centered over a submerged oil and gas formation 14 located below sea floor 16. Wellhead 18 is located on deck 20 of platform 12. Well 22 extends through the sea 24 and penetrates the various earth strata including formation 14 to form wellbore 26. Disposed within wellbore 26 is casing 28. Disposed within casing 28 and extending from wellhead 18 is production tubing 30. A pair of seal assemblies 32, 34 provide a seal between tubing 30 and casing 28 to prevent the flow of production fluids therebetween. During production, formation fluids enter wellbore 26 through perforations 36 in casing 28 and travel into tubing 30 to wellhead 18.

Coupled within tubing 30 is a tubing retrievable safety valve 38. As is well known in the art, multiple tubing retrievable safety valves are commonly installed as part of tubing string 30 to shut in production from formation 14 in response to a variety of abnormal and potentially dangerous conditions. For convenience of illustration, however, only tubing retrievable safety valve 38 is shown.

Tubing retrievable safety valve 38 is operated by hydraulic fluid pressure communicated thereto from surface installation 40 and hydraulic fluid control conduit 42. Hydraulic fluid pressure must be applied to tubing retrievable safety valve 38 to place tubing retrievable safety valve 38 in the open position. When hydraulic fluid pressure is lost, tubing retrievable safety valve 38 will operate to the closed position to prevent formation fluids from traveling therethrough.

If, for example, tubing retrievable safety valve 38 is unable to properly seal in the closed position or does not properly open after being in the closed position, tubing retrievable safety valve 38 must typically be repaired or replaced. In the present invention, however, the functionality of tubing retrievable safety valve 38 may be replaced by wireline retrievable safety valve 44, which may be installed within tubing retrievable safety valve 38 via wireline assembly 46 including wireline 48. Once in place within tubing retrievable safety valve 38, wireline retrievable safety valve 44 will be operated by hydraulic fluid pressure communicated thereto from surface installation 40 and hydraulic fluid line 42 through tubing retrievable safety valve 38. As with the original configuration of tubing retrievable safety valve 38, the hydraulic fluid pressure must be applied to wireline retrievable safety valve 44 to place wireline retrievable safety valve 44 in the open position. If hydraulic fluid pressure is lost, wireline retrievable safety valve 44 will operate to the closed position to prevent formation fluids from traveling therethrough.

Even though FIG. 1 depicts a cased vertical well, it should be noted by one skilled in the art that the present invention is equally well-suited for uncased wells, deviated wells or horizontal wells. Also, even though FIG. 1 depicts an offshore operation, it should be noted by one skilled in the art that the present invention is equally well-suited for use in onshore operations.

Figure 2A:
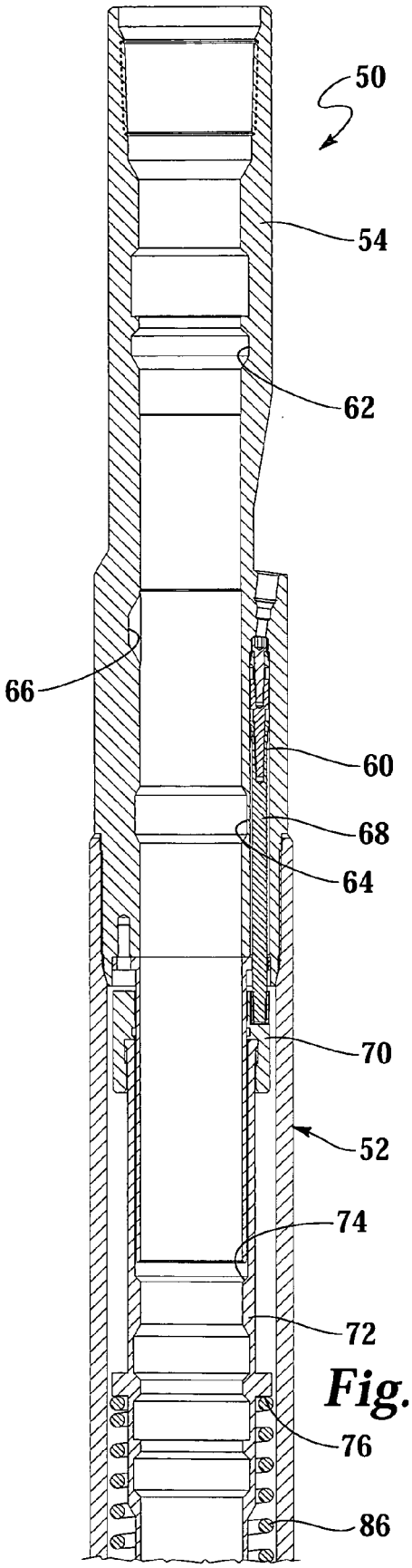
FIGS. 2A–2B are cross sectional views of successive axial sections of a rod piston operated tubing retrievable safety valve of the present invention in its valve closed position.
Figure 2B:
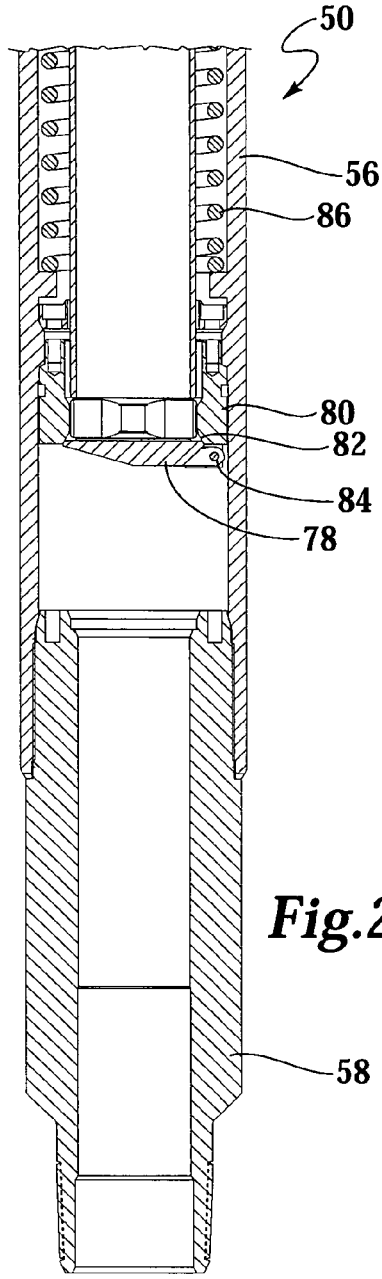

Referring now to FIGS. 2A and 2B, therein is depicted cross sectional views of successive axial sections a tubing retrievable safety valve embodying principles of the present invention that is representatively illustrated and generally designated 50. Safety valve 50 may be connected directly in series with production tubing 30 of FIG. 1. Safety valve 50 has a substantially cylindrical outer housing 52 that includes top connector subassembly 54, intermediate housing subassembly 56 and bottom connector subassembly 58 which are threadedly and sealing coupled together.

It should be apparent to those skilled in the art that the use of directional terms such as top, bottom, above, below, upper, lower, upward, downward, etc. are used in relation to the illustrative embodiments as they are depicted in the figures, the upward direction being toward the top of the corresponding figure and the downward direction being toward the bottom of the corresponding figure. As such, it is to be understood that the downhole components described herein may be operated in vertical, horizontal, inverted or inclined orientations without deviating from the principles of the present invention.

Top connector subassembly 54 includes a substantially cylindrical longitudinal bore 60 that serves as a hydraulic fluid chamber. Top connector subassembly 54 also includes a profile 62 and a radially reduced area 64. In accordance with an important aspect of the present invention, top connector subassembly 54 has a pocket 66. In the illustrated embodiment, the center of pocket 66 is circumferentially displaced 180 degrees from longitudinal bore 60. It will become apparent to those skilled in the art that pocket 66 could alternatively be displaced circumferentially from longitudinal bore 60 at many other angles. Likewise, it will become apparent to those skilled in the art that more than one pocket 66 could be used. In that configuration, the multiple pockets 66 could be displaced axially from one another along the interior surface of top connector subassembly 54.

Hydraulic control pressure is communicated to longitudinal bore 60 of safety valve 50 via control conduit 42 of FIG. 1. A rod piston 68 is received in slidable, sealed engagement against longitudinal bore 60. Rod piston 68 is connected to a flow tube adapter 70 which is threadedly connected to a flow tube 72. Flow tube 72 has profile 74 and a downwardly facing annular shoulder 76.

A flapper plate 78 is pivotally mounted onto a hinge subassembly 80 which is disposed within intermediate housing subassembly 56. A valve seat 82 is defined within hinge subassembly 80. It should be understood by those skilled in the art that while the illustrated embodiment depicts flapper plate 78 as the valve closure mechanism of safety valve 50, other types of safety valves including those having different types of valve closure mechanisms may be used without departing from the principles of the present invention, such valve closure mechanisms including, but not limited to, rotating balls, reciprocating poppets and the like.

In normal operation, flapper plate 78 pivots about pivot pin 84 and is biased to the valve closed position by a spring (not pictured). When safety valve 50 must be operated from the valve closed position, depicted in FIGS. 2A–2B, to the valve opened position, depicted in FIGS. 3A–3B, hydraulic fluid enters longitudinal bore 60 and acts on rod piston 68. As the downward hydraulic force against rod piston 68 exceeds the upward bias force of spiral wound compression spring 86, flow tube 72 moves downwardly with rod piston 68. As flow tube 72 continues to move downwardly, flow tube 72 contacts flapper closure plate 78 and forces flapper closure plate 78 to the open position.

When safety valve 50 must be operated from the valve open position to the valve closed position, hydraulic pressure is released from conduit 42 such that spring 86 acts on shoulder 76 and upwardly bias flow tube 72. As flow tube 72 is retracted, flapper closure plate 78 will rotate about pin 84 and seal on seat 82.

If safety valve 50 becomes unable to properly seal in the closed position or does not properly open after being in the closed position, it is desirable to reestablish the functionality of safety valve 50 without removal of tubing 30. In the present invention this is achieved by inserting a lock out and communication tool into the central bore of safety valve 50.

Figure 4A:
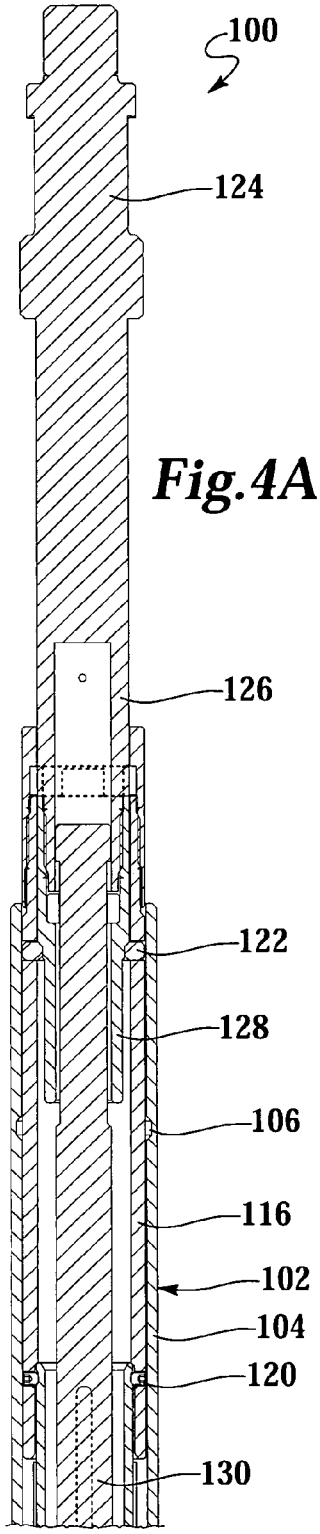
FIGS. 4A–4B are cross sectional views of successive axial sections of a communication tool of the present invention.
Figure 4B:
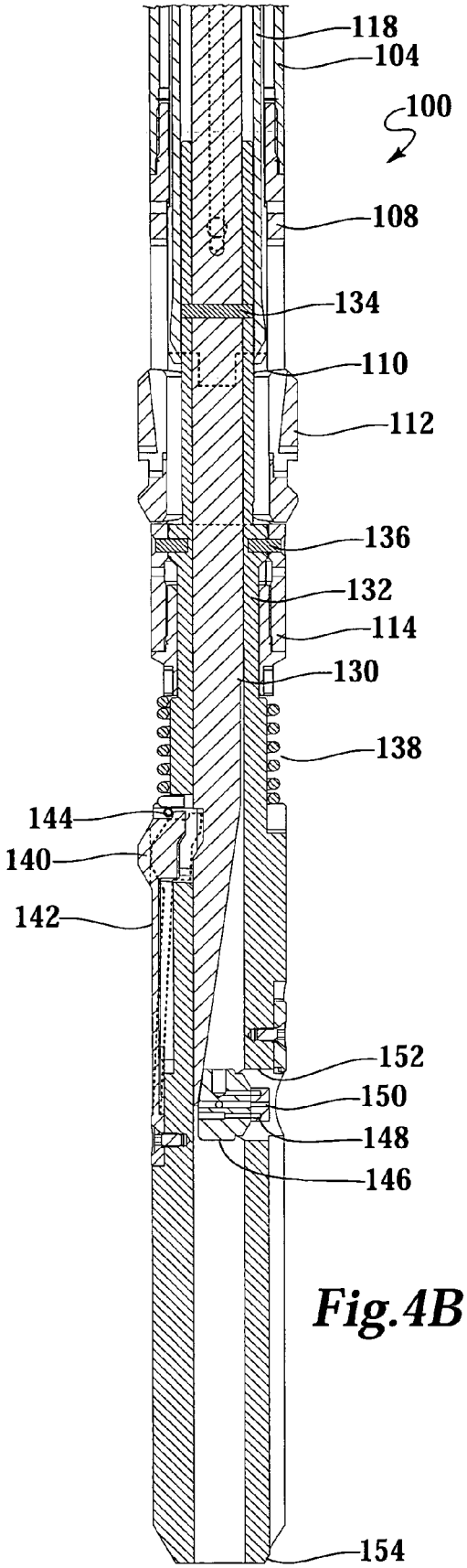

Referring now to FIGS. 4A–4B, therein is depicted cross sectional views of successive axial sections a lock out and communication tool embodying principles of the present invention that is representatively illustrated and generally designated 100. Communication tool 100 has an outer housing 102. Outer housing 102 has an upper subassembly 104 that has a radially reduced interior section 106. Outer housing 102 also has a key retainer subassembly 108 including windows 110 and a set of axial locating keys 112. In addition, outer housing 102 has a lower housing subassembly 114.

Slidably disposed within outer housing 102 is upper mandrel 116 that is securably coupled to expander mandrel 118 by attachment members 120. Upper mandrel 116 carries a plurality of dogs 122. Partially disposed and slidably received within upper mandrel 116 is a fish neck 124 including a fish neck mandrel 126 and a fish neck mandrel extension 128. Partially disposed and slidably received within fish neck mandrel 126 and fish neck mandrel extension 128 is a punch rod 130. Punch rod 130 extends down through communication tool 100 and is partially disposed and selectively slidably received within main mandrel 132.

Punch rod 130 and main mandrel 132 are initially fixed relative to one another by shear pin 134. Main mandrel 132 is also initially fixed relative to lower housing subassembly 114 of outer housing 102 by shear pins 136. Shear pins 136 not only prevent relative axial movement between main mandrel 132 and lower housing subassembly 114 but also prevent relative rotation between main mandrel 132 and lower housing subassembly 114. A torsional load is initially carried between main mandrel 132 and lower housing subassembly 114. This torsional load is created by spiral wound torsion spring 138.

Attached to main mandrel 132 is a circumferential locating key 140 on the upper end of collet spring 142. Circumferential locating key 140 includes a retaining pin 144 that limits the outward radial movement of circumferential locating key 140 from main mandrel 132. Disposed within main mandrel 132 is a carrier 146 that has an insert 148 on the outer surface thereof. Insert 148 includes an internal fluid passageway 150. Carrier 146 and insert 148 are radially extendable through window 152 of main mandrel 132. Main mandrel 132 has a downwardly facing annual shoulder 154.

Figure 5A:
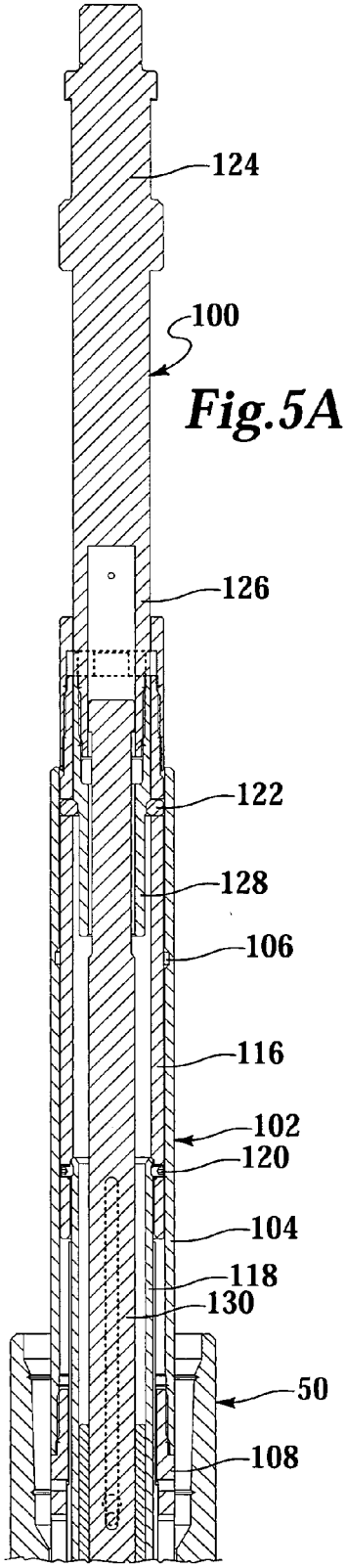
FIGS. 5A–5B are cross sectional views of successive axial sections of a communication tool of the present invention in its running position and disposed in a rod piston operated tubing retrievable safety valve of the present invention.
Figure 5B:
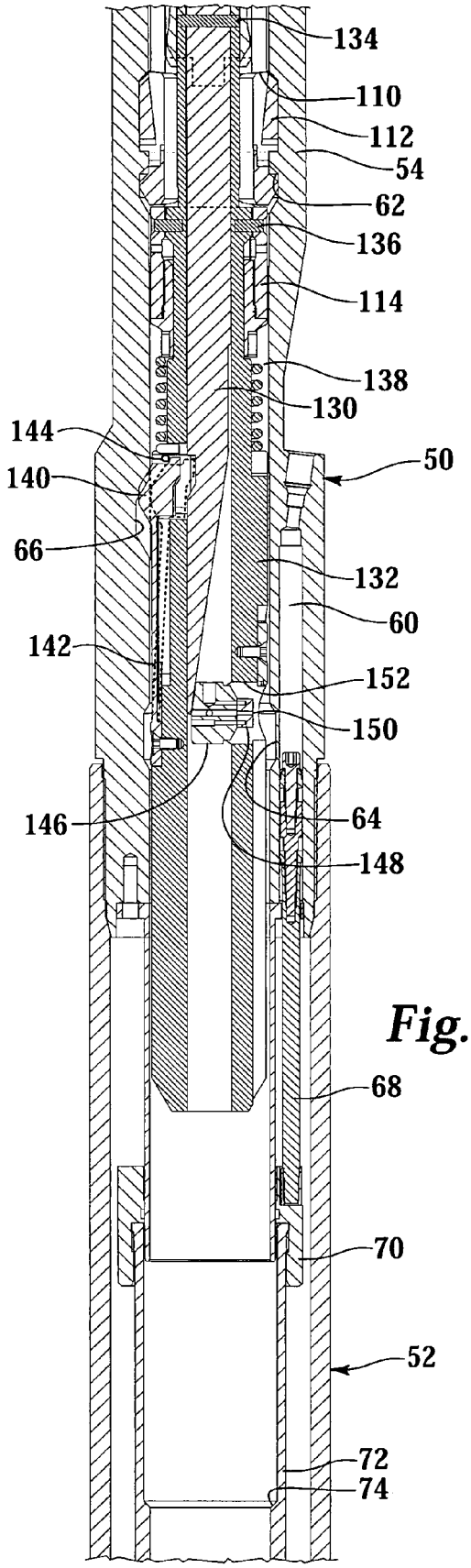

The operation of communication tool 100 of the present invention will now be described relative to safety valve 50 of the present invention with reference to FIGS. 5A–5B, 6A–6B, 7A–7B, 8A–8B and 9A–9B. In FIGS. 5A–5B, communication tool 100 is in its running configuration. Communication tool 100 is positioned within the longitudinal central bore of safety valve 50. As communication tool 100 is lowered into safety valve 50, downwardly facing annular shoulder 154 of main mandrel 132 contacts profile 74 of flow tube 72. Main mandrel 132 may downwardly shift flow tube 72, either alone or in conjunction with an increase in the hydraulic pressure within longitudinal chamber 60, operating flapper closure plate 78 from the closed position, see FIGS. 2A–2B, to the fully open position, see FIGS. 3A–3B. Alternatively, if safety valve 50 is already in the open position, main mandrel 132 simply holds flow tube 72 in the downward position to maintain safety valve 50 in the open position. Communication tool 100 moves downwardly relative to outer housing 52 of safety valve 50 until axial locating keys 112 of communication tool 100 engage profile 62 of safety valve 50.

Figure 6A:
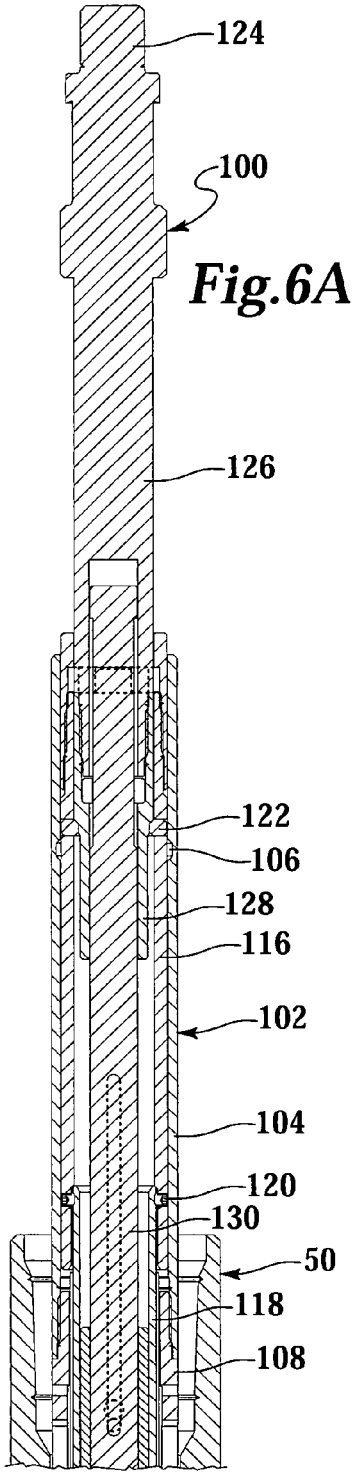
FIGS. 6A–6B are cross sectional views of successive axial sections of a communication tool of the present invention in its locked position and disposed in a rod piston operated tubing retrievable safety valve of the present invention.
Figure 6B:
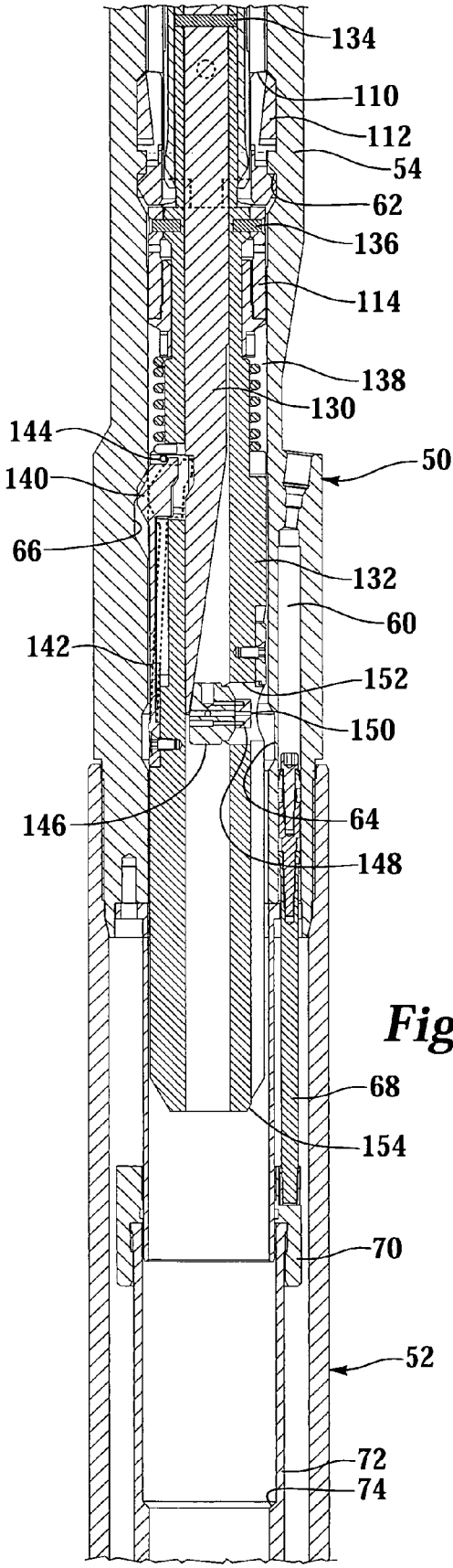

Once axial locating keys 112 of communication tool 100 engage profile 62 of safety valve 50, downward jarring on communication tool 100 shifts fish neck 124 along with fish neck mandrel 126, fish neck mandrel extension 128, upper mandrel 116 and expander mandrel 118 downwardly relative to safety mandrel 50 and punch rod 130. This downward movement shifts expander mandrel 118 behind axial locating keys 112 which locks axial locating keys 112 into profile 62, as best seen in FIGS. 6A–6B.

Figure 7A:
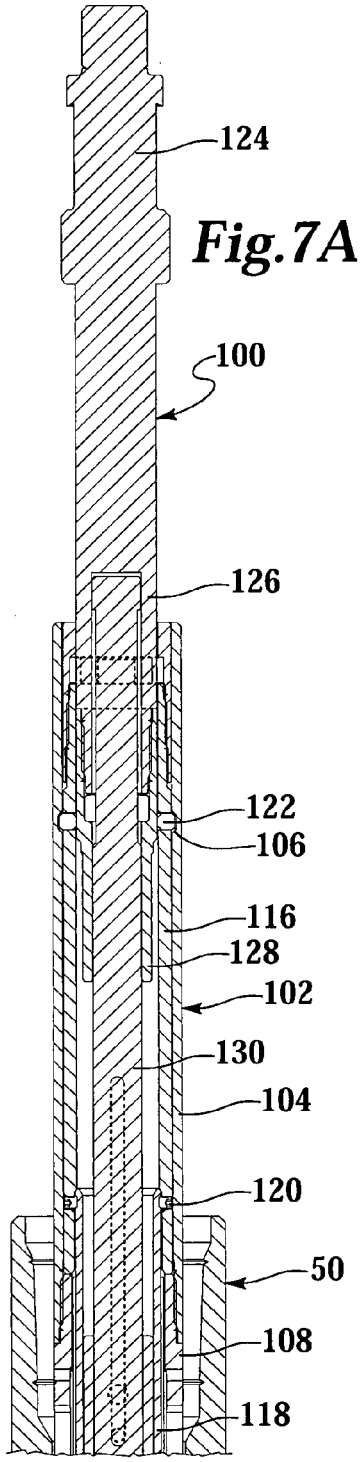
FIGS. 7A–7B are cross sectional views of successive axial sections of a communication tool of the present invention in its orienting position and disposed in a rod piston operated tubing retrievable safety valve of the present invention.
Figure 7B:
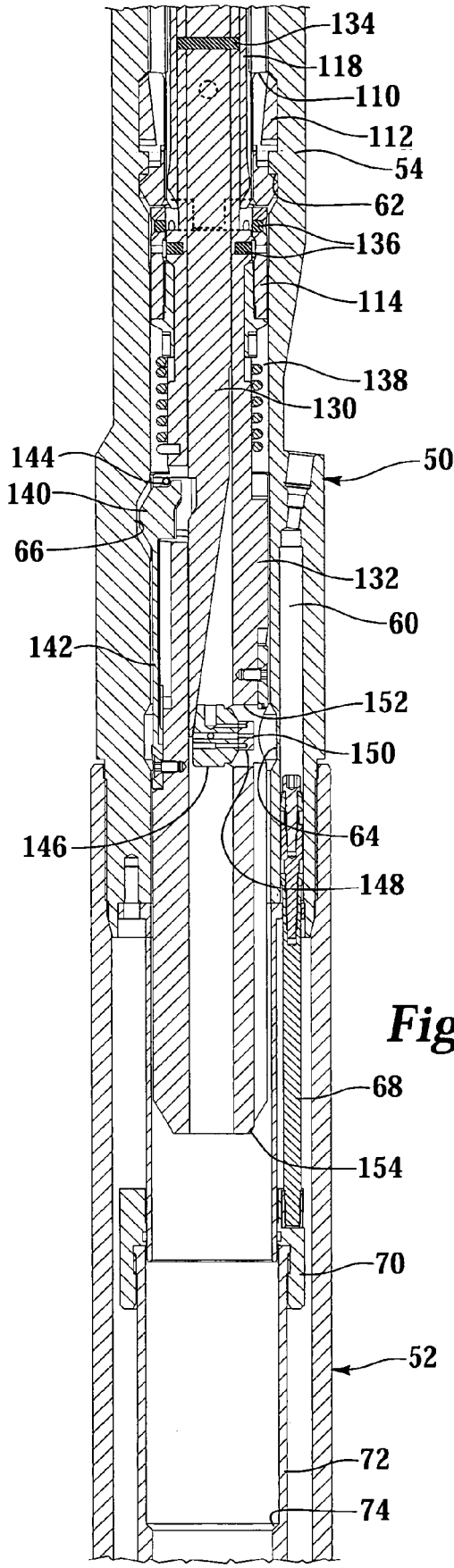

In this locked configuration of communication tool 100, dogs 122 are aligned with radially reduced interior section 106 of upper housing subassembly 104. As such, additional downward jarring on communication tool 100 outwardly shifts dogs 122 which allows fish neck mandrel extension 128 to move downwardly. This allows the lower surface of fish neck 124 to contact the upper surface of punch rod 130. Continued downward jarring with a sufficient and predetermined force shears pins 136, as best seen in FIGS. 7A–7B. When pins 136 shear, this allows punch rod 130 and main mandrel 132 to move axially downwardly relative to housing 102 and expander mandrel 118 of communication tool 100 and safety valve 50. This downward movement axially aligns carrier 146 and insert 148 with radially reduced area 64 and axially aligns circumferential locating key 140 with pocket 66 of safety valve 50.

In addition, when pins 136 shear, this allows punch rod 130 and main mandrel 132 to rotate relative to housing 102 and expander mandrel 118 of communication tool 100 and safety valve 50 due to the torsional force stored in torsion spring 138. This rotational movement circumferentially aligns carrier 146 and insert 148 with longitudinal bore 60 of safety valve 50. This is achieved due to the interaction of circumferential locating key 140 and pocket 66. Specifically, as punch rod 130 and main mandrel 132 rotate relative to safety valve 50, collet spring 142 radially outwardly biases circumferential locating key 140. Thus, when circumferential locating key 140 becomes circumferentially aligned with pocket 66, circumferential locating key 140 moves radially outwardly into pocket 66 stopping the rotation of punch rod 130 and main mandrel 132 relative to safety valve 50. By axially and circumferentially aligning circumferential locating key 140 with pocket 66, carrier 146 and insert 148 become axially and circumferentially aligned with longitudinal bore 60 of safety valve 50.

Figure 8A:
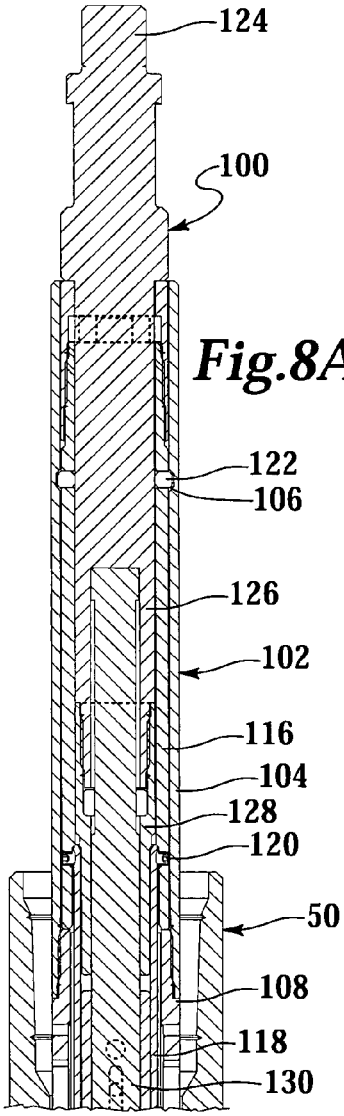
FIGS. 8A–8B are cross sectional views of successive axial sections of a communication tool of the present invention in its perforating position and disposed in a rod piston operated tubing retrievable safety valve of the present invention.
Figure 8B:
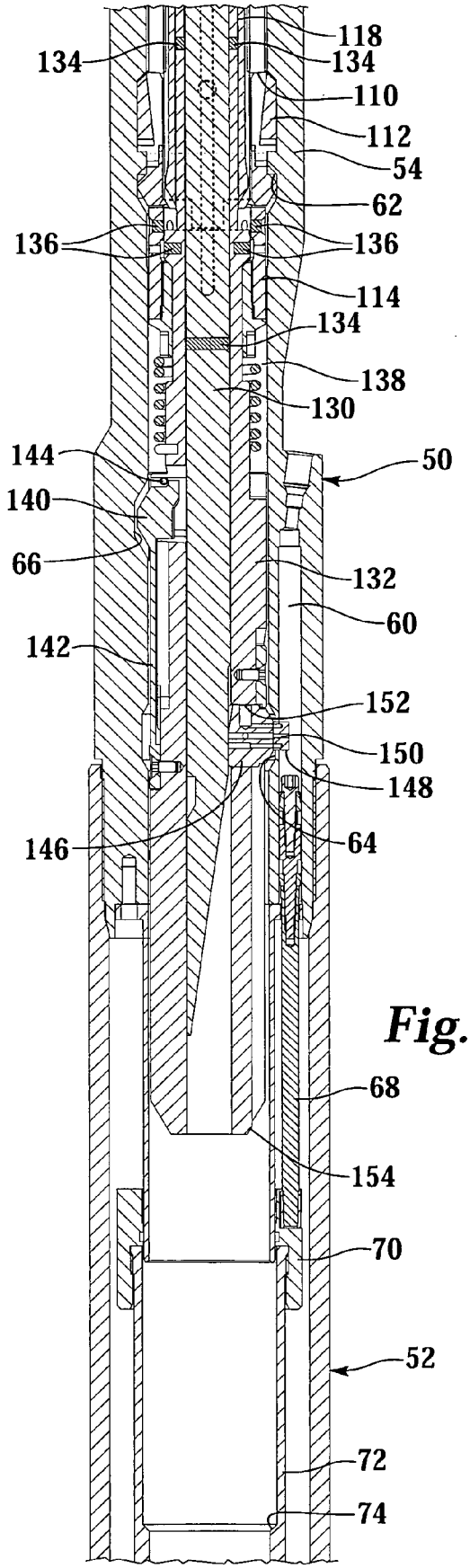

Once carrier 146 and insert 148 are axially and circumferentially aligned with longitudinal bore 60 of safety valve 50, communication tool 100 is in its perforating position, as depicted in FIGS. 8A–8B. In this configuration, additional downward jarring on communication tool 100, of a sufficient and predetermined force, shears pin 134 which allow punch rod 130 to move downwardly relative to main mandrel 132. As punch rod 130 move downwardly, insert 148 penetrates radially reduced region 64 of safety valve 50. The depth of entry of insert 148 into radially reduced region 64 is determined by the number of jars applied to punch rod 130. The number of jars applied to punch rod 130 is predetermined based upon factors such as the thickness of radially reduced region 64 and the type of material selected for outer housing 52.

Figure 9A:
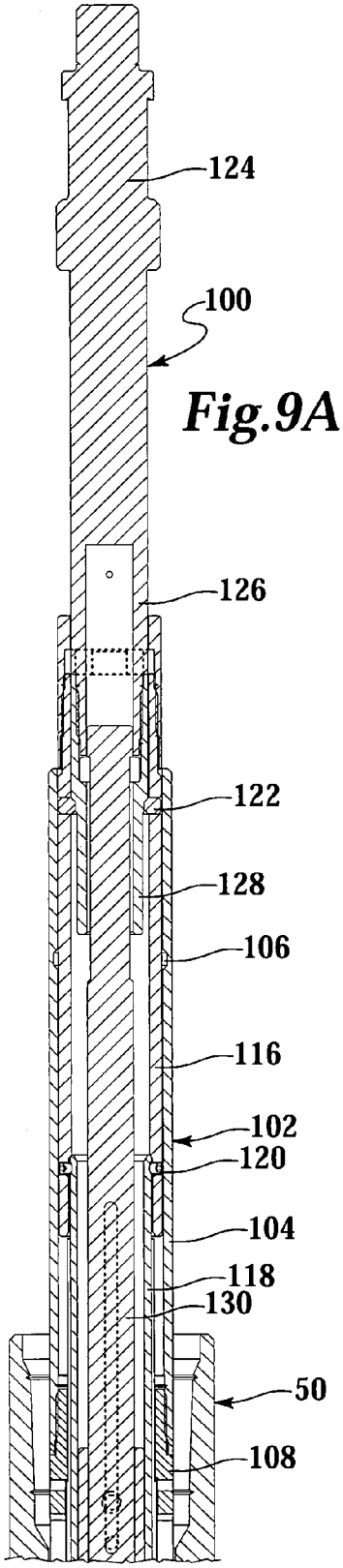
FIGS. 9A–9B are cross sectional views of successive axial sections of a communication tool of the present invention in its retrieving position and still substantially disposed in a rod piston operated tubing retrievable safety valve of the present invention.
Figure 9B:
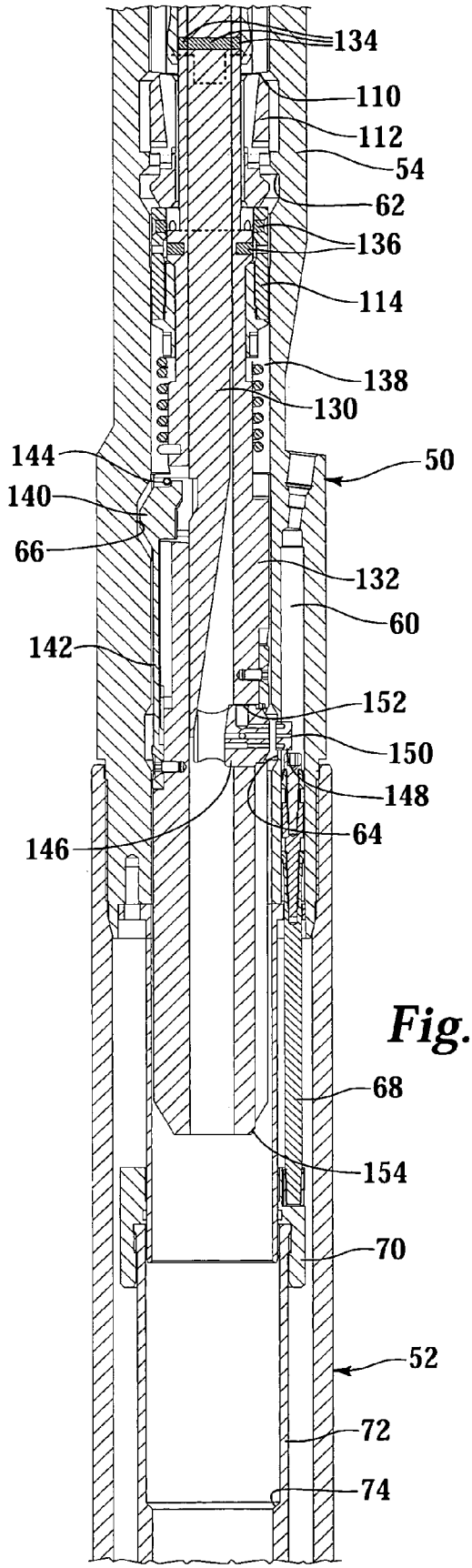

With the use of communication tool 100 of the present invention, fluid passageway 150 of insert 148 provides a communication path for hydraulic fluid from longitudinal bore 60 to the interior of safety valve 50. Once insert 148 is fixed within radially reduced region 64, communication tool 100 may be retrieved to the surface, as depicted in FIGS. 9A–9B. In this configuration, punch rod 130 has retracted from behind carrier 146, fish neck mandrel extension 128 has retracted from behind keys 106 and expander mandrel 118 has retracted from behind axial locating keys 112 which allows communication tool 100 to release from safety valve 50. Insert 148 now prevents the upward movement of rod piston 68 and flow tube 72 which in turn prevents closure of flapper closure plate 78, thereby locking out safety valve 50. In addition, flow passageway 150 of insert 148 allow for the communication of hydraulic fluid from longitudinal bore 60 to the interior of safety valve 50 which can be used, for example, to operate a wireline retrievable subsurface safety valve that is inserted into locked out safety valve 50.

Figure 10A:
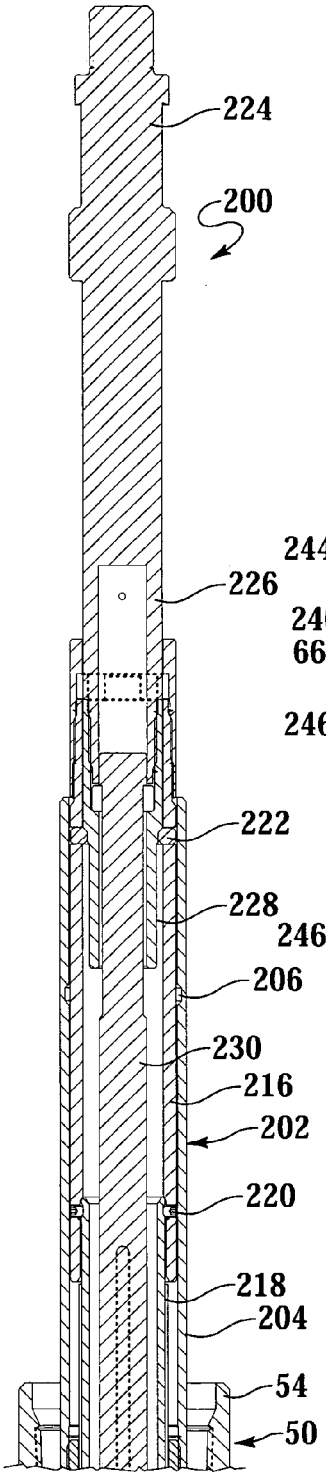
FIGS. 10A–10C are cross sectional views of successive axial sections of a lock out and communication tool of the present invention disposed in a rod piston operated tubing retrievable safety valve of the present invention.
Figure 10B:
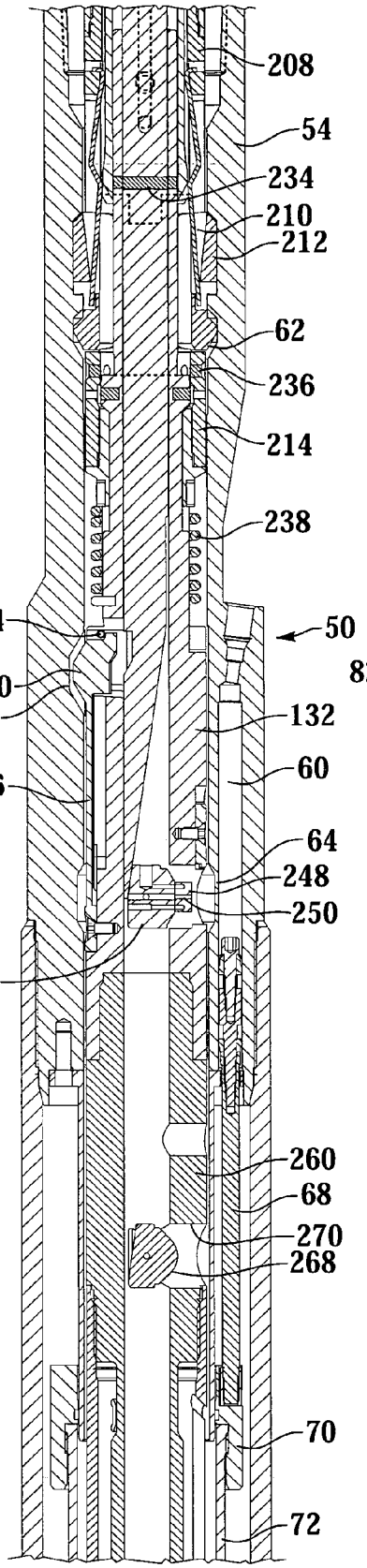
Figure 10C:
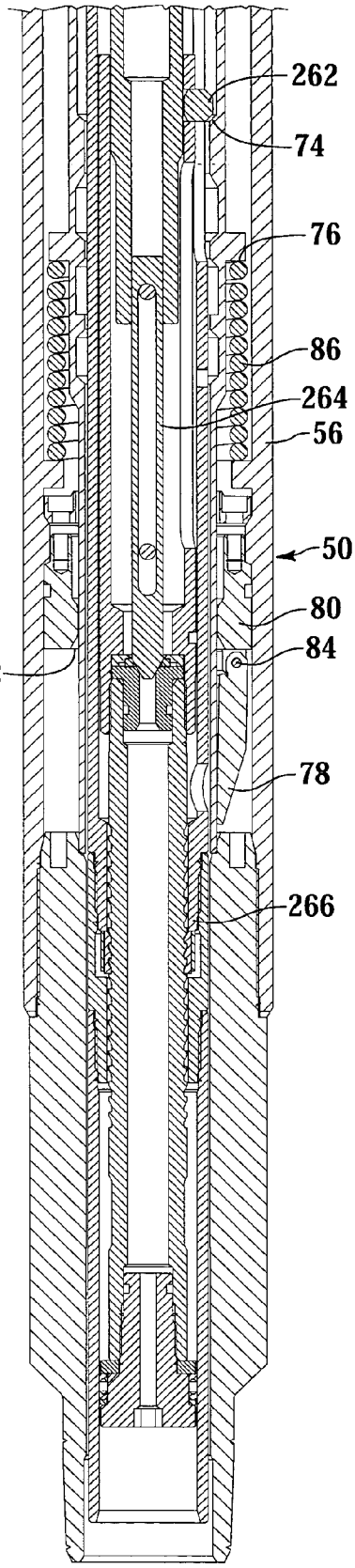

Referring now to FIGS. 10A–10C, therein is depicted cross sectional views of successive axial sections a lock out and communication tool embodying principles of the present invention that is representatively illustrated and generally designated 200. The communication tool portion of lock out and communication tool 200 has an outer housing 202. Outer housing 202 has an upper subassembly 204 that has a radially reduced interior section 206. Outer housing 202 also has a key retainer subassembly 208 including windows 210 and a set of axial locating keys 212. In addition, outer housing 202 has a lower housing subassembly 214.

Slidably disposed within outer housing 202 is upper mandrel 216 that is securably coupled to expander mandrel 218 by attachment members 220. Upper mandrel 216 carries a plurality of dogs 222. Partially disposed and slidably received within upper mandrel 216 is a fish neck 224 including a fish neck mandrel 226 and a fish neck mandrel extension 228. Partially disposed and slidably received within fish neck mandrel 226 and fish neck mandrel extension 228 is a punch rod 230. Punch rod 230 extends down through lock out and communication tool 200 and is partially disposed and selectively slidably received within main mandrel 232 and main mandrel extension 260 of the lock out portion of lock out and communication tool 200.

Punch rod 230 and main mandrel 232 are initially fixed relative to one another by shear pin 234. Main mandrel 232 is also initially fixed relative to lower housing subassembly 214 of outer housing 202 by shear pins 236. Shear pins 236 not only prevent relative axial movement between main mandrel 232 and lower housing subassembly 214 but also prevent relative rotation between main mandrel 232 and lower housing subassembly 214. A torsional load is initially carried between main mandrel 232 and lower housing subassembly 214. This torsional load is created by spiral wound torsion spring 238.

Attached to main mandrel 232 is a circumferential locating key 240 on the upper end of collet spring 242. Circumferential locating key 240 includes a retaining pin 244 that limits the outward radial movement of circumferential locating key 240 from main mandrel 232. Disposed within main mandrel 232 is a carrier 246 that has an insert 248 on the outer surface thereof. Insert 248 includes an internal fluid passageway 250. Carrier 246 and insert 248 are radially extendable through window 222 of main mandrel 232. Main mandrel 232 is threadedly attached to main mandrel extension 260. In the illustrated embodiment, the lock out portion of lock out and communication tool 200 also includes a lug 262 with contacts upper shoulder 74, a telescoping section 264 and a ratchet section 266. In addition, a piston the lock out portion of lock out and communication tool 200 includes a dimpling member 268 that is radially extendable through a window 270.

Figure 3A:
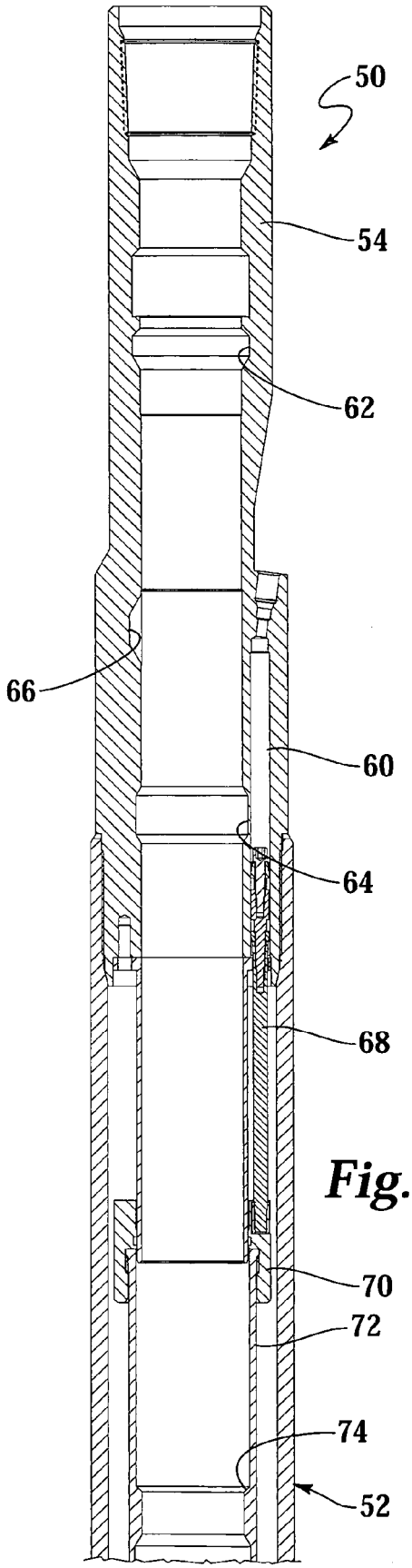
FIGS. 3A–3B are cross sectional views of successive axial sections of a rod piston operated tubing retrievable safety valve of the present invention in its valve open position.
Figure 3B:
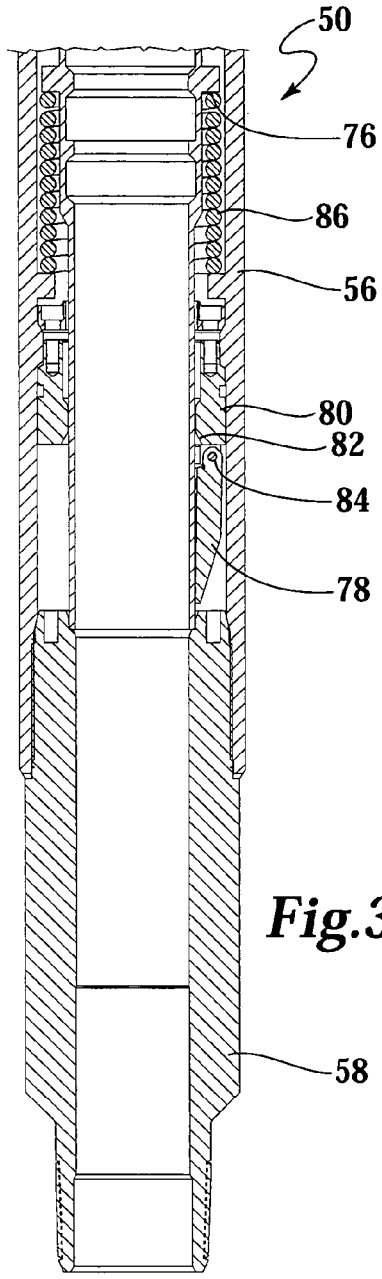

In operation, as lock out and communication tool 200 is positioned within the longitudinal central bore of safety valve 50 as described above with reference to tool 100, flapper closure plate 78 is operated from the closed position, see FIGS. 2A–2B, to the fully open position, see FIGS. 3A–3B. Lock out and communication tool 200 moves downwardly relative to outer housing 52 of safety valve 50 until axial locating keys 212 of lock out and communication tool 200 engage profile 62 of safety valve 50 and are locked therein.

In this locked configuration of lock out and communication tool 200, shears pins 236 may be sheared in response to downward jarring which allows punch rod 230 and main mandrel 232 to move axially downwardly relative to housing 202 and expander mandrel 218 of lock out and communication tool 200 and safety valve 50. As explained above, this downward movement axially aligns carrier 246 and insert 248 with radially reduced area 64. In addition, circumferential locating key 240 is both axially and circumferentially aligned with pocket 66 of safety valve 50.

By axially and circumferentially aligning circumferential locating key 240 with pocket 66, carrier 246 and insert 248 become axially and circumferentially aligned with longitudinal bore 60 of safety valve 50 such that additional downward jarring on lock out and communication tool 200 of a sufficient and predetermined force shears pin 234 which allow punch rod 230 to move downwardly relative to main mandrel 232 and main mandrel extension 260. As punch rod 230 move downwardly, insert 248 penetrates radially reduced region 64 of safety valve 50. Further travel of punch rod 230 downwardly relative to main mandrel 232 and main mandrel extension 260 causes dimpling member 268 to contact and form a dimple in the inner wall of safety valve 50 which prevents upward travel of piston 68 after lock out and communication tool 200 is retrieved from safety valve 50.

The unique interaction of lock out and communication tool 200 of the present invention with safety valve 50 of the present invention thus allows for the locking out of a rod piston operated safety valve and for the communication of its hydraulic fluid to operate, for example, an insert valve.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A communication tool for creating a fluid passageway between a non annular hydraulic chamber and an interior of a tubing retrievable safety valve having a profile, the communication tool comprising:

a housing having recesses, the housing having a first section and a second section that are initially coupled together by a shear pin;

a mandrel slidably disposed within the housing;

a set of axial locating elements radially extendable through the recesses and engagably positionable within the profile when the mandrel is axially moved relative to the housing behind the axial locating elements;

an anti rotation device radially outwardly extendable relative to the housing, the anti rotation device operably engageable with the tubing retrievable safety valve to substantially prevent relative rotation between at least a portion of the communication tool and the tubing retrievable safety valve; and a cutting tool radially outwardly extendable relative to the housing, the cutting tool operable to create a fluid passageway between the non annular hydraulic chamber and the interior of the tubing retrievable safety valve.

2. The communication tool as recited in claim 1 further comprising a torsional biasing device coupled between the first section and the second section which places a torsional load between the first and second sections when the first and second sections are coupled together and rotates the second section relative to the first section when the first and section sections are decoupled.

3. The communication tool as recited in claim 1 wherein the cutting tool further comprises a radial cutting tool.

4. The communication tool as recited in claim 1 wherein the cutting tool further comprises a mechanical cutting tool.

5. The communication tool as recited in claim 1 wherein the cutting tool further comprises a punch.

6. The communication tool as recited in claim 5 further comprising a punch rod slidably operable relative to the housing to radially outwardly extend the punch through a sidewall portion of the tubing retrievable safety valve and into the non annular hydraulic chamber.

7. The communication tool as recited in claim 1 wherein the cutting tool further comprises an insert having a fluid passageway.

8. The communication tool as recited in claim 1 wherein the anti rotation device is positioned circumferentially opposite of the cutting tool.

9. The communication tool as recited in claim 1 wherein the anti rotation device further comprises a collet spring.

10. The communication tool as recited in claim 1 wherein the cutting tool is axially and circumferentially alignable with the non annular hydraulic chamber when the axial locating elements are engagably positioned within the profile and the anti rotation device is operably engaged with the tubing retrievable safety valve.

11. A communication tool for creating a fluid passageway between a non annular hydraulic chamber and an interior of a tubing retrievable safety valve having a profile, the communication tool comprising:

a housing having recesses, the housing having a first section and a second section that are initially coupled together by a shear pin;

a mandrel slidably disposed within the housing;

a set of axial locating elements radially extendable through the recesses and engagably positionable within the profile when the mandrel is axially moved relative to the housing behind the axial locating elements;

an anti rotation device radially outwardly extendable relative to the housing, the anti rotation device operably engageable with the tubing retrievable safety valve to substantially prevent relative rotation between at least a portion of the communication tool and the tubing retrievable safety valve; and a cutting tool radially outwardly extendable relative to the housing, the cutting tool axially and circumferentially alignable with the non annular hydraulic chamber when the axial locating elements are engagably positioned within the profile and the anti rotation device is operably engaged with the tubing retrievable safety valve.

12. The communication tool as recited in claim 11 further comprising a torsional biasing device coupled between the first section and the second section which places a torsional load between the first and second sections when the first and second sections are coupled together and rotates the second section relative to the first section when the first and section sections are decoupled.

13. The communication tool as recited in claim 11 wherein the cutting tool further comprises a radial cutting tool.

14. The communication tool as recited in claim 11 wherein the cutting tool further comprises a mechanical cutting tool.

15. The communication tool as recited in claim 11 wherein the cutting tool further comprises a punch.

16. The communication tool as recited in claim 15 further comprising a punch rod slidably operable relative to the housing to radially outwardly extend the punch through a sidewall portion of the tubing retrievable safety valve and into the non annular hydraulic chamber.

17. The communication tool as recited in claim 11 wherein the cutting tool further comprises an insert having a fluid passageway.

18. The communication tool as recited in claim 11 wherein the anti rotation device is positioned circumferentially opposite of the cutting tool.

19. The communication tool as recited in claim 11 wherein the anti rotation device further comprises a collet spring.

20. A communication tool for creating a fluid passageway between a non annular hydraulic chamber and an interior of a tubing retrievable safety valve having a profile, the communication tool comprising:

a housing having recesses, the housing having a first section and a second section that are initially coupled together by a shear pin;

a set of axial locating elements radially extendable through the recesses and engagably positionable within the profile;

an anti rotation device radially outwardly extendable relative to the housing, the anti rotation device operably engageable with the tubing retrievable safety valve to substantially prevent relative rotation between at least a portion of the communication tool and the tubing retrievable safety valve; and a cutting tool radially outwardly extendable relative to the housing, the cutting tool operable to create a fluid passageway between the non annular hydraulic chamber and the interior of the tubing retrievable safety valve.

21. The communication tool as recited in claim 20 further comprising a torsional biasing device coupled between the first section and the second section which places a torsional load between the first and second sections when the first and second sections are coupled together and rotates the second section relative to the first section when the first and section sections are decoupled.

22. The communication tool as recited in claim 20 wherein the cutting tool further comprises a radial cutting tool.

23. The communication tool as recited in claim 20 wherein the cutting tool further comprises a mechanical cutting tool.

24. The communication tool as recited in claim 20 wherein the cutting tool further comprises a punch.

25. The communication tool as recited in claim 24 further comprising a punch rod slidably operable relative to the housing to radially outwardly extend the punch through a sidewall portion of the tubing retrievable safety valve and into the non annular hydraulic chamber.

26. The communication tool as recited in claim 20 wherein the cutting tool further comprises an insert having a fluid passageway.

27. The communication tool as recited in claim 20 wherein the anti rotation device is positioned circumferentially opposite of the cutting tool.

28. The communication tool as recited in claim 20 wherein the anti rotation device further comprises a collet spring.

29. The communication tool as recited in claim 20 wherein the cutting tool is axially and circumferentially alignable with the non annular hydraulic chamber when the axial locating elements are engagably positioned within the profile and the anti rotation device is operably engaged with the tubing retrievable safety valve.

30. A communication tool for creating a fluid passageway between a non annular hydraulic chamber and an interior of a tubing retrievable safety valve having a profile, the communication tool comprising:

a housing having recesses;

a mandrel slidably disposed within the housing;

a set of axial locating elements radially extendable through the recesses and engagably positionable within the profile when the mandrel is axially moved relative to the housing behind the axial locating elements;

an anti rotation device comprising a collet spring that is radially outwardly extendable relative to the housing, the anti rotation device operably engageable with the tubing retrievable safety valve to substantially prevent relative rotation between at least a portion of the communication tool and the tubing retrievable safety valve; and a cutting tool radially outwardly extendable relative to the housing, the cutting tool operable to create a fluid passageway between the non annular hydraulic chamber and the interior of the tubing retrievable safety valve.

31. The communication tool as recited in claim 30 wherein the housing has a first section and a second section that are initially coupled together by a shear pin.

32. The communication tool as recited in claim 31 further comprising a torsional biasing device coupled between the first section and the second section which places a torsional load between the first and second sections when the first and second sections are coupled together and rotates the second section relative to the first section when the first and section sections are decoupled.

33. The communication tool as recited in claim 30 wherein the cutting tool further comprises a radial cutting tool.

34. The communication tool as recited in claim 30 wherein the cutting tool further comprises a mechanical cutting tool.

35. The communication tool as recited in claim 30 wherein the cutting tool further comprises a punch.

36. The communication tool as recited in claim 35 further comprising a punch rod slidably operable relative to the housing to radially outwardly extend the punch through a sidewall portion of the tubing retrievable safety valve and into the non annular hydraulic chamber.

37. The communication tool as recited in claim 30 wherein the cutting tool further comprises an insert having a fluid passageway.

38. The communication tool as recited in claim 30 wherein the anti rotation device is positioned circumferentially opposite of the cutting tool.

39. The communication tool as recited in claim 30 wherein the cutting tool is axially and circumferentially alignable with the non annular hydraulic chamber when the axial locating elements are engagably positioned within the profile and the anti rotation device is operably engaged with the tubing retrievable safety valve.

40. A communication tool for creating a fluid passageway between a non annular hydraulic chamber and an interior of a tubing retrievable safety valve having a profile, the communication tool comprising:

a housing having recesses;

a mandrel slidably disposed within the housing;

a set of axial locating elements radially extendable through the recesses and engagably positionable within the profile when the mandrel is axially moved relative to the housing behind the axial locating elements;

an anti rotation device comprising a collet spring that is radially outwardly extendable relative to the housing, the anti rotation device operably engageable with the tubing retrievable safety valve to substantially prevent relative rotation between at least a portion of the communication tool and the tubing retrievable safety valve; and a cutting tool radially outwardly extendable relative to the housing, the cutting tool axially and circumferentially alignable with the non annular hydraulic chamber when the axial locating elements are engagably positioned within the profile and the anti rotation device is operably engaged with the tubing retrievable safety valve.

41. The communication tool as recited in claim 40 wherein the housing has a first section and a second section that are initially coupled together by a shear pin.

42. The communication tool as recited in claim 41 further comprising a torsional biasing device coupled between the first section and the second section which places a torsional load between the first and second sections when the first and second sections are coupled together and rotates the second section relative to the first section when the first and section sections are decoupled.

43. The communication tool as recited in claim 40 wherein the cutting tool further comprises a radial cutting tool.

44. The communication tool as recited in claim 40 wherein the cutting tool further comprises a mechanical cutting tool.

45. The communication tool as recited in claim 40 wherein the cutting tool further comprises a punch.

46. The communication tool as recited in claim 45 further comprising a punch rod slidably operable relative to the housing to radially outwardly extend the punch through a sidewall portion of the tubing retrievable safety valve and into the non annular hydraulic chamber.

47. The communication tool as recited in claim 40 wherein the cutting tool further comprises an insert having a fluid passageway.

48. The communication tool as recited in claim 40 wherein the anti rotation device is positioned circumferentially opposite of the cutting tool.

49. A communication tool for creating a fluid passageway between a non annular hydraulic chamber and an interior of a tubing retrievable safety valve having a profile, the communication tool comprising:

a housing having recesses;

a set of axial locating elements radially extendable through the recesses and engagably positionable within the profile;

an anti rotation device comprising a collet spring that is radially outwardly extendable relative to the housing, the anti rotation device operably engageable with the tubing retrievable safety valve to substantially prevent relative rotation between at least a portion of the communication tool and the tubing retrievable safety valve; and a cutting tool radially outwardly extendable relative to the housing, the cutting tool operable to create a fluid passageway between the non annular hydraulic chamber and the interior of the tubing retrievable safety valve.

50. The communication tool as recited in claim 49 wherein the housing has a first section and a second section that are initially coupled together by a shear pin.

51. The communication tool as recited in claim 50 further comprising a torsional biasing device coupled between the first section and the second section which places a torsional load between the first and second sections when the first and second sections are coupled together and rotates the second section relative to the first section when the first and section sections are decoupled.

52. The communication tool as recited in claim 49 wherein the cutting tool further comprises a radial cutting tool.

53. The communication tool as recited in claim 49 wherein the cutting tool further comprises a mechanical cutting tool.

54. The communication tool as recited in claim 49 wherein the cutting tool further comprises a punch.

55. The communication tool as recited in claim 54 further comprising a punch rod slidably operable relative to the housing to radially outwardly extend the punch through a sidewall portion of the tubing retrievable safety valve and into the non annular hydraulic chamber.

56. The communication tool as recited in claim 49 wherein the cutting tool further comprises an insert having a fluid passageway.

57. The communication tool as recited in claim 49 wherein the anti rotation device is positioned circumferentially opposite of the cutting tool.

58. The communication tool as recited in claim 49 wherein the cutting tool is axially and circumferentially alignable with the non annular hydraulic chamber when the axial locating elements are engagably positioned within the profile and the anti rotation device is operably engaged with the tubing retrievable safety valve.

* * * * *